United States Patent [19]

Voillot

[11] Patent Number: 4,496,041

[45] Date of Patent: Jan. 29, 1985

[54] APPARATUS FOR INTRODUCING PROJECTILES INTO ARTILLERY TURRETS

[75] Inventor: Hervé Voillot, Sartrouville, France

[73] Assignee: Creusot-Loire, Paris, France

[21] Appl. No.: 384,688

[22] Filed: Jun. 3, 1982

[30] Foreign Application Priority Data

Jun. 9, 1981 [FR] France ..... 81 11306

[51] Int. Cl.[3] ..... B65G 47/26

[52] U.S. Cl. ..... 198/457; 198/461; 198/608; 198/722; 89/34

[58] Field of Search ..... 198/722, 608, 461, 462, 198/577, 579, 457; 89/33 B, 34

[56] References Cited

U.S. PATENT DOCUMENTS

| | | | |
|---|---|---|---|
| 1,885,892 | 11/1932 | Bronander | 198/457 |
| 2,993,411 | 7/1961 | Goldsmith | 89/33 B |
| 3,992,182 | 11/1976 | Frank | 198/461 |
| 4,143,753 | 3/1979 | Bergens | 198/608 |

FOREIGN PATENT DOCUMENTS

| | | | |
|---|---|---|---|
| 2483066 | 11/1981 | France | 89/34 |

*Primary Examiner*—Joseph E. Valenza
*Assistant Examiner*—Kyle E. Shane

[57] ABSTRACT

Apparatus for introducing elongate objects (M) into a transfer corridor (4) from a feed corridor (10) along which the objects (M) are axially moved in sequence. The transfer corridor (4) has star wheels (3') driven rotationally in synchronism, each wheel (3') having at least one socket whose section corresponds to that of the object. A receiving wheel (1) receives the objects (M) at the outlet of the feed corridor (10), to which wheel the guide members (4) of the transfer corridor are extended. The receiving wheel (1) is rotated at regular intervals corresponding to the rhythm of succession of the objects. At least one intermediate wheel (2) is interposed between the receiving wheel (1) and a first transfer wheel (3) for the passage of the objects (M) from one wheel to the other. The intermediate wheel (2) is rotationally driven continuously and at variable speed between the angular velocity of the receiving wheel (1) and that of the transfer wheel (3).

5 Claims, 8 Drawing Figures

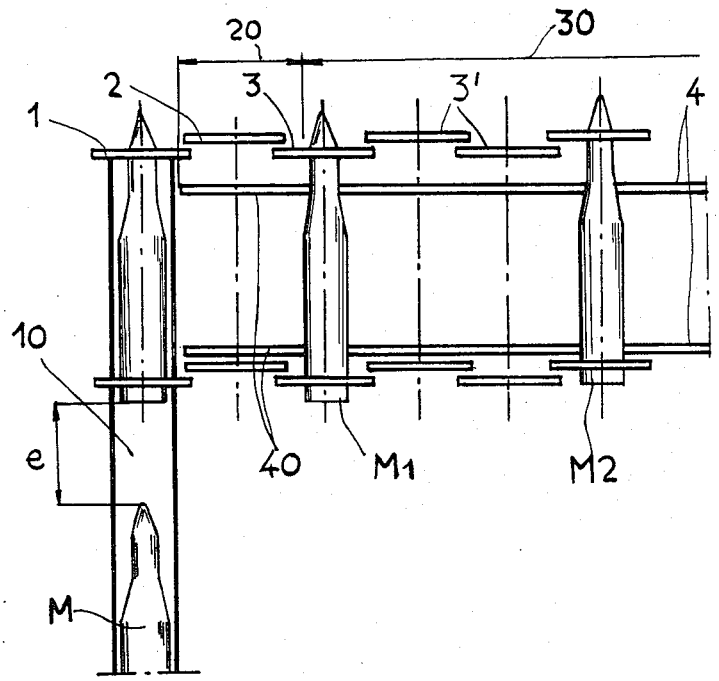
Fig 1
Fig 2
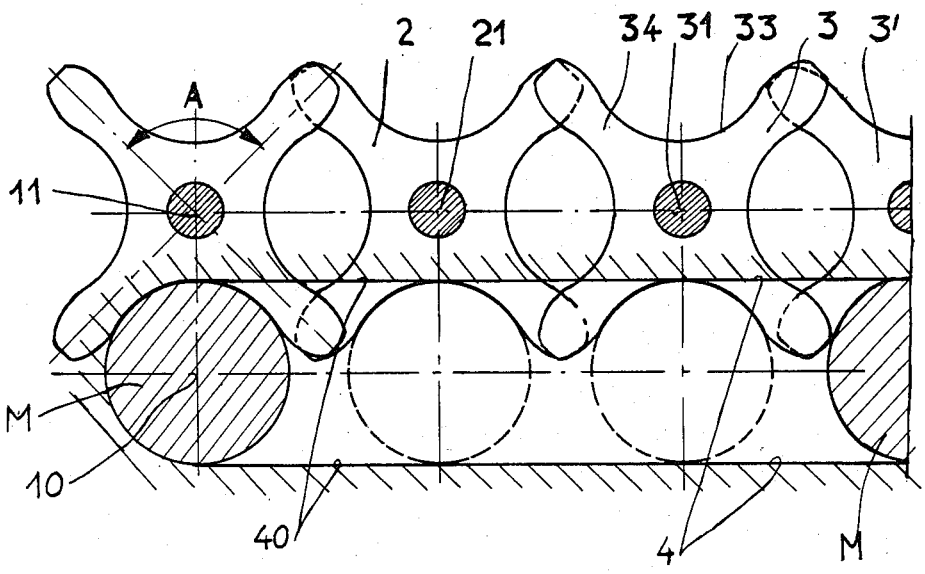

APPARATUS FOR INTRODUCING PROJECTILES INTO ARTILLERY TURRETS

FIELD OF THE INVENTION

The invention relates to an apparatus for introducing projectiles into a transfer corridor in which these objects are conveyed side by side in a direction at right angles to their axis, and is more particularly applicable to the feeding of ammunition to artillery turrets.

BACKGROUND OF THE INVENTION

An artillery turret is composed schematically of a gun barrel mounted on a frame oscillating about two trunnions defining a horizontal axis on a support which itself turns about a vertical axis. The projectiles are placed in a magazine disposed under the mounting and must therefore be conveyed one after the other to the gun barrel. For this purpose the magazine is connected to the mounting by a feed corridor in which the projectiles, introduced automatically or manually, are moved one behind the other in the direction of their axes. On leaving the feed corridor, the projectiles pass into a transfer corridor, which brings them to the gun barrel and which is therefore composed of two parts: a fixed corridor situated in the mounting and a movable corridor situated in the oscillating frame.

In the transfer corridor the projectiles are normally moved side by side in a direction at right angles to their axis, this arrangement making it possible in particular to turn the projectiles gradually so as to bring them into a direction parallel to the gun barrel in order to facilitate their introduction into the breech.

In order to bring about the movement of the projectiles parallel to their axis, the transfer corridor is generally provided with a series of star wheels mounted for rotation about axes at right angles to the axis of the corridor, while the latter is bounded by two parallel guide members spaced apart by a distance equal to the diameter of the projectiles.

Each of the star wheels comprises at least two sockets of a section corresponding to that of the object, each of these sockets being framed by two arms which respectively attend to the taking-over of the object coming from the preceding plate and to pushing it to the following plate.

Thus, at the same time as the object is pushed out of the socket, the next socket takes over the object coming from the preceding wheel. The star wheels comprise in most cases four sockets separated by four arms, and thus have the shape of a Maltese cross.

Consequently, there is a discontinuity between the rhythm of succession of the objects in the feed corridor and that in the transfer corridor, because in the feed corridor the objects move one behind the other in the direction of their axes and therefore arrive discontinuously at the outlet, whereas in the transfer corridor it is possible because of the star wheels to effect the movement of the objects continuously.

The invention provides a solution to this problem with the aid of an apparatus making it possible for the projectiles arriving discontinuously at the outlet of the feed corridor to be introduced continuously into the transfer corridor.

SUMMARY OF THE INVENTION

The introduction apparatus according to the invention comprises a wheel for receiving objects at the outlet of the feed corridor, to which wheel the guide members of the transfer corridor are extended; this wheel has at least one socket adapted to be centered on the axis of the feed corridor by rotation about an axis at right angles to the guide members at regular intervals corresponding to the rhythm of succession of the objects at the outlet of the feed corridor. Control means being about periodically the rotation of the receiver wheel through an angle (A) corresponding to the replacement of the socket by the next socket in the axis of the feed corridor; an intermediate wheel, also associated with the guide members and provided with a number of sockets equal to the number of sockets in the transfer wheels, is interposed between the receiver plate and the first transfer plate for the purpose of passing the objects from one wheel to the other in the sockets by rotation about an axis at right angles to the guide members. The rotation of the intermediate wheel is effected by drive means, for continuous driving at variable speed, which are associated with control means for progressive periodic variations of the speed of rotation between an angular velocity equal to that of the receiver wheel and an angular velocity equal to that of the transfer wheel for each fraction of a revolution corresponding to the passing of a projectile from the receiver plate to the transfer wheel.

In a preferred embodiment the means of periodic control of the rotation of the receiver wheel is composed of an indexing member driven in continuous rotation by the main drive means at an angular velocity of one revolution per cycle of replacement of an object by the next object, the indexing member being adapted to engage for a fraction of a revolution on a slope associated with each socket in the receiver wheel and forming a cam controlling the rotation of the wheel at a progressively increasing or decreasing angular velocity between two stop positions separated by the socket replacement angle (A).

The apparatus preferably has a single intermediate wheel effecting the connection between the receiver plate and the first transfer wheel, and the indexing member produces an angular velocity of rotation of the receiver wheel which progressively increases up to a speed equal to that of the transfer wheels and then progressively decreases, while the means for controlling the periodic variations of speed of the intermediate wheel effect a deceleration thereof down to a speed equal to that of the receiver wheel and then an increase of its speed in synchronism with the receiver wheel up to the speed of the transfer plates during the rotation through the angle which is necessary for passing the objects from the receiver wheel to the intermediate plate, and finally the maintenance of the connecting wheel in synchronism with the transfer wheel at least during the rotation through the angle necessary for the passage of the object from the intermediate wheel to the first transfer wheel, the speed again decreasing, at the beginning of the next cycle, down to the speed of the receiver wheel.

In a particular embodiment the means for the rotational driving of the intermediate wheel is composed of a differential, of which one planet gear is driven rotationally by the main drive means in synchronism with the transfer wheels, while the other planet gear controls the rotation of the intermediate wheel, and the means controlling the variations of speed of the intermediate wheel is an arm controlling the orientation of the differential gear carrier shaft of the differential, the end of which arm cooperates with a cam driven rotationally by the main drive means at an angular velocity of one revolution per object replacement cycle and the profile of which cam brings about, with the aid of the differential and in dependence on the transmission ratios, the continuous variation, in each cycle, of the speed of the intermediate wheel between the speed of the receiver wheel and the speed of the transfer wheels.

Thus, through the use of a variable speed intermediate wheel it is possible for each projectile to be passed progressively and smoothly to the speed of the transfer corridor.

At the outlet of the feed corridor the receiver wheel is in fact stopped during the time necessary for it to be loaded with the projectile coming from the feed corridor. For reasons of safety, the projectiles are obviously separated by an interval corresponding to the time required for the replacement of the receiver wheel socket by the next socket. This replacement is itself effected at variable speed, since the speed of the receiver wheel is progressively increased until it turns at a speed higher than that of the transfer wheels. During this time the intermediate wheel, driven rotationally in synchronism with the receiver wheel, has been able to take over the projectile coming from the receiver wheel. As the result of this increase in speed, it has been possible to overtake the position of the first transfer wheel, which is driven in continuous rotation. The speed of the receiver wheel and of the intermediate wheel is then reduced, at the end of the take-over movement by the intermediate wheel, down to the speed of the transfer wheels. From that moment onwards the receiver wheel slows down again until it stops in the position in which the next socket is centered on the axis of the feed corridor and the intermediate wheel assumes the speed of the transfer wheel in order to push the projectile towards the latter.

It can thus be seen that, because of the periodic variations of speed of the receiver wheel and of the intermediate wheel, it is possible to introduce the projectiles smoothly and continuously into the transfer corridor.

However, the invention will be better understood with the aid of the following detailed description of one particular embodiment, which is given solely by way of example and illustrated in the accompanying drawings.

BRIEF DESCRIPTION OF THE DRAWINGS

FIG. 1 shows very schematically the junction between a feed corridor and a transfer corridor.

FIG. 2 is a front view of the plates, in section through a plane at right angles to their axes.

DETAILED DESCRIPTION

Figure 3:
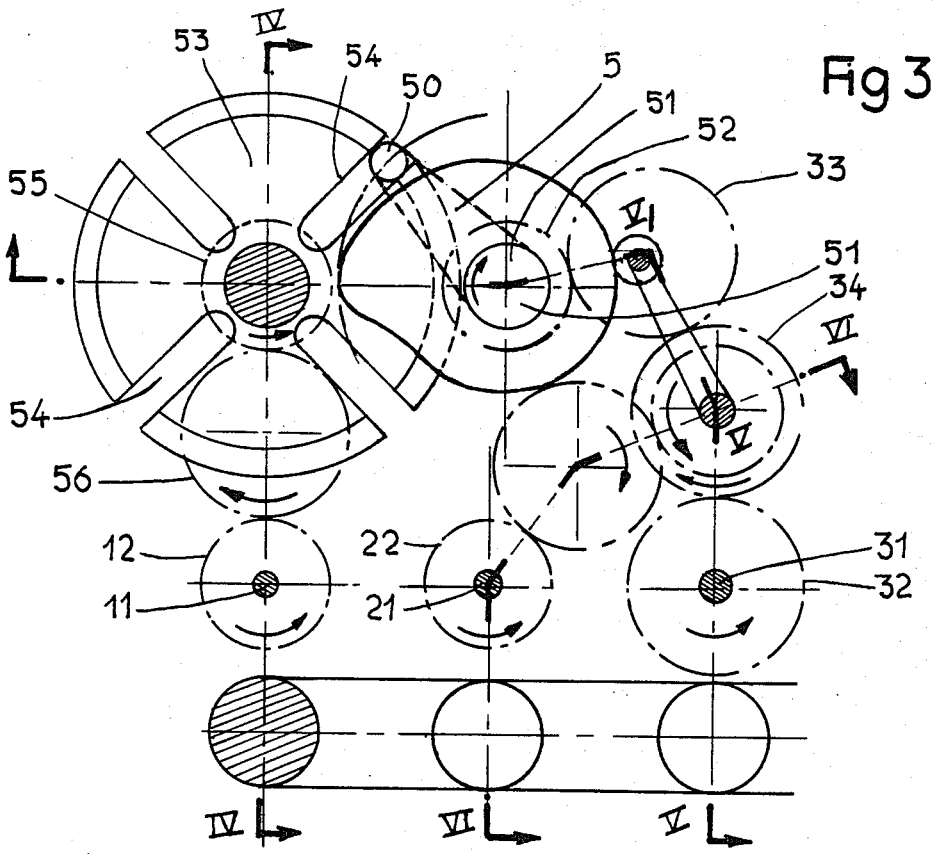
FIG. 3 is a diagram of the entire mechanical speed variation device.
Figure 4:
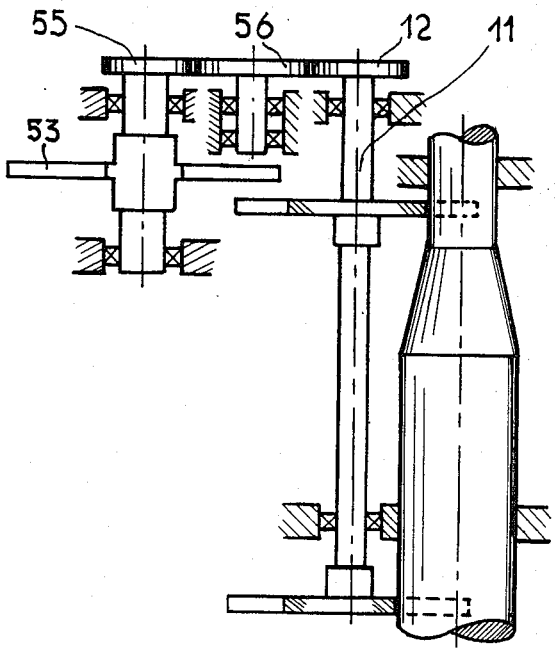
FIG. 4 shows the control of the receiver wheel, in section on the line IV—IV in FIG. 3.

In FIG. 1 a vertical feed corridor 10 is shown schematically, in which the projectiles M are moved one following the other in the direction of their axes, separated from one another by a safety space (e).

At the outlet of the feed corridor 10 the projectiles are received in a pair of socketed wheels 1 and are conducted into the transfer corridor 30 by way of an intermediate corridor 20.

The transfer corridor comprises, in very conventional manner, a series of star wheels 3' associated with parallel guides 4.

The intermediate corridor 20 comprises a single pair of plates 2 interposed between the receiver wheels 1 and the first pair of wheels 3 of the series of wheels 3' of the transfer corridor 30.

In the same way, the intermediate plates 20 are associated with guides 40 situated in line with the guides 4 of the transfer corridor.

In conventional manner, as illustrated in FIG. 2, each transfer wheel, such as the plate 3, comprises four sockets, between which pusher arms are disposed. The sockets have a curvature corresponding to that of the projectiles M, and the wheels therefore have, schematically, the shape of a Maltese cross.

Figure 5:
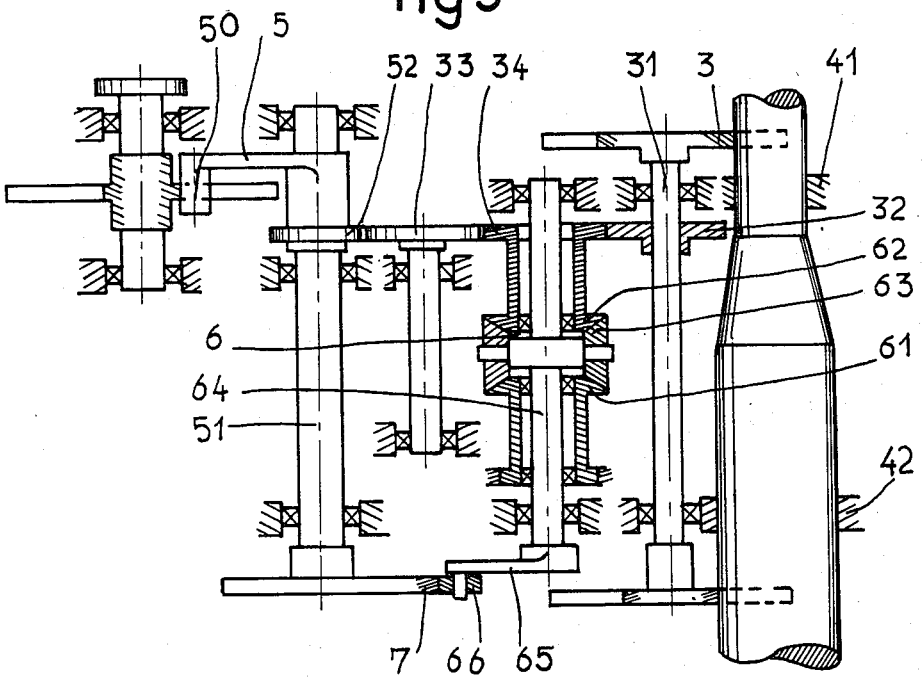
FIG. 5 shows the indexing and speed variation control in a developed section on the broken line V—V in FIG. 3.
Figure 6:
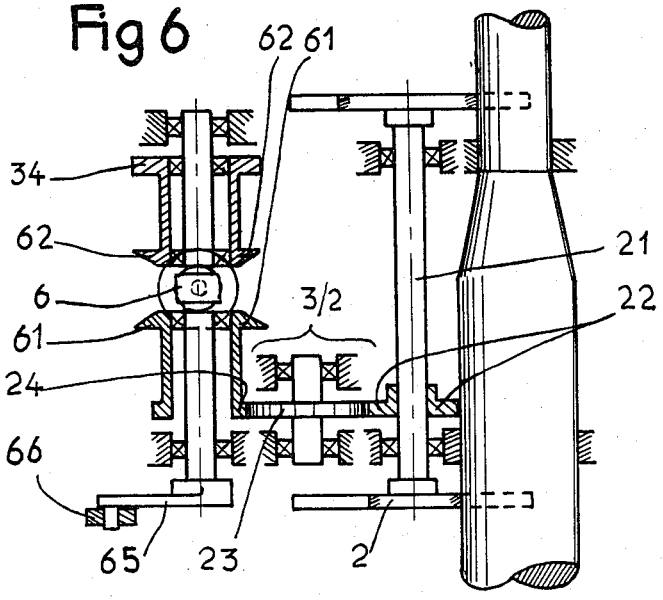
FIG. 6 shows the control mechanism of the intermediate wheel in a developed section on the broken line VI—VI in FIG. 3.

The guide means, such as the guides 40 in the intermediate corridor and the guides 4 in the transfer corridor, are parallel and spaced apart by a distance equal to the diameter of the projectile. This distance obviously corresponds to the position where the guide members make contact. As can be seen in FIG. 5, use is made of two pairs of guide members, of which one, the guide member 41 called the front guide member, bears against the missile, while the other guide member 42 bears against the shell case. Similarly, the diameters of the sockets in the wheels are different, since one of the wheels, called the front wheel, bears against the missile, while the other wheel, called the rear wheel, bears against the shell case.

The two front and rear wheels are fastened on a common drive shaft at right angles to the guide members, and the shafts of the plates 3' of the transfer corridor are driven in synchronism and in the same direction by a main drive means (not shown). Consequently, everything said with regard to the front wheel will also apply to the rear wheel, and whenever mention is made below of a wheel, this will obviously mean the pair of front and rear wheels.

In the example illustrated, two projectiles $M_1$ and $M_2$ (FIG. 1) are separated from one another in the transfer column 30 by two free gaps shown in dashed lines in FIG. 2. This arrangement, which is not indispensable, facilitates smooth transfer of the projectiles by leaving in the transfer corridor 30 a gap of two places which corresponds to the periodicity with which the projectiles M arrive one after the other in the receiver wheel 1. This has the consequence that each wheel 3 makes three-quarters of a turn between the moments when it takes over two successive projectiles, i.e., in each projectile replacement cycle. Thus, in this embodiment the wheel must have four sockets angularly separated by one quarter of a turn. It is this consideration that leads to the use of a Maltese cross shape, which is the most usual shape, but it would for example have been possible to use wheels having a single socket if three places were left free between the projectiles.

The intermediate wheel 2 must have the same number of sockets as the wheel 3. On the other hand, the receiver wheel 1 could have only a single socket, since a certain time is available, after the projectile has been pushed out of the loaded socket, for turning the wheel and returning the socket into the axis of the feed corridor. Nevertheless, for the purpose of simplification, the receiver plate 1 is given the same shape of a Maltese cross with four sockets as the other wheels, and in this way the angle (A) through which the wheel 1 must be turned in order to bring the next socket into the axis 10 of the feed corridor is 90°.

The pairs of wheels 1, 2, 3 are each fastened respectively on rotary shafts 11, 21, 31 driven respectively by pinions 12, 22, 32 shown in the bottom part of FIG. 3, which is a general schematic view of the drive mechanism.

The pinion 32 driving the shaft 31 of the wheel 3 is driven in synchronism with the drive pinions of all the wheels 3' of the transfer corridor 30 by a general drive kinematic chain symbolised in FIG. 5 by a pinion 33 driven rotationally at a speed of three-quarters of a turn per cycle, this pinion, in the figure, driving in the same direction and at the same speed the pinion 32 of the same diameter with the aid of a pinion 34.

The main drive pinion 33 also controls the rotation of an indexer 5 composed of a finger 50 fixed at the end of a crank fastened on a shaft 51 driven rotationally by the pinion 33 with the aid of a pinion 52, the number of teeth of which is calculated in dependence on the number of teeth of the pinion 33, in such a manner that the shaft 51 turns at a speed of 1 turn per cycle. This has the consequence that the indexing finger 50 makes one complete revolution during the time required for the replacement of one projectile by the next.

The indexing finger 50 cooperates with an indexing plate 53, on which are provided four rectilinear slots 54 directed towards the axis of the plate 53 and spaced apart at angles of 90°. The depth of the slots 54 corresponds to the position occupied by the indexing finger 50 when the crank 5 is directed towards the center of the plate 53. In this way, on turning about the shaft 51, the indexing finger 50, engaging in a slot 54, turns the plate 53 through an angle of 90° at a progressively increasing speed and then at a progressively decreasing speed. The slot 54 thus forms a cam whose profile determines the variation of speed, and it is quite certain that, if a rectilinear shape is simpler, many other shapes giving other speed variation laws could be conceived.

As the result of this arrangement, the plate 53 therefore turns through 90° per cycle at a variable speed depending on the shape of the cam 54. On the shaft of the plate 53 is fastened a pinion 55 connected by a kinematic chain, for example a pinion 56, to the drive pinion 12 of the shaft 11 of the receiver wheel 1. The pinions 12 and 55 have the same diameter and are driven rotationally in the same direction and at the same speed. Thus, the indexer 5 controls the rotation, at one quarter turn per cycle and at variable speed, of the receiver wheel 1.

The speed of rotation of the indexer 5 is regulated in dependence on the speed of displacement of the projectiles M in the feed corridor 10, in such a manner that the receiver wheel 1 turns one quarter turn, and consequently effects the replacement of one socket by the next, in a time (T) shorter than the time taken by the projectile M to pass through the space (e) separating it from the preceding projectile. Thus, during this time (T) the receiver wheel pushes the projectile M, which it had taken over, into the intermediate corridor 20 and brings the next socket into the waiting position in the axis of the feed corridor 10.

Figure 8:
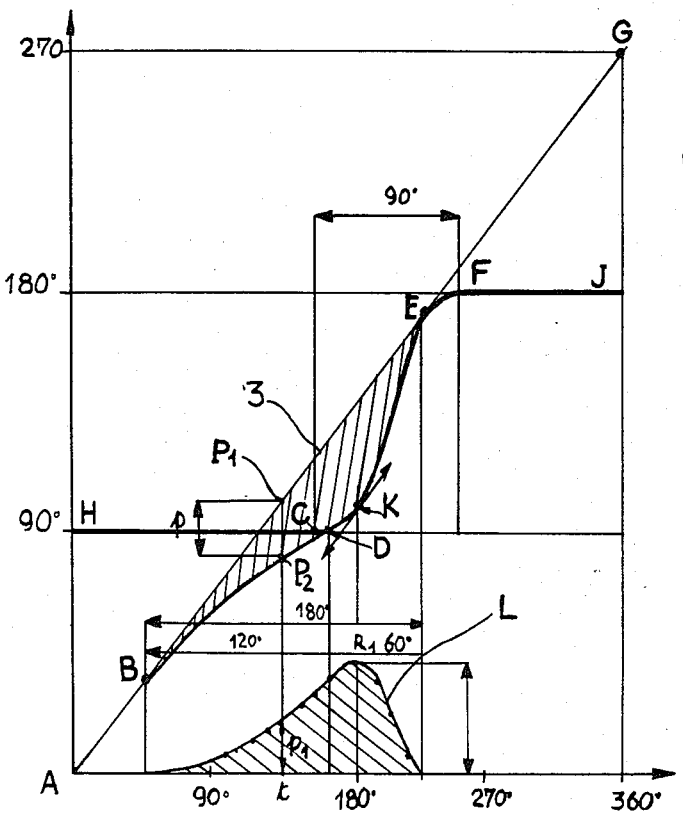
FIG. 8 is an operating diagram of the assembly comprising the three wheels.

These movements of the transfer wheel 3 and receiver wheel 1 have been illustrated in FIG. 8, which is a graph showing on the abscissa the angle of rotation of the indexing drive shaft 51 turning at 1 turn per cycle, and on the ordinate the angles of rotation of the star wheels.

It has been seen that in each cycle the transfer wheel 3 turns three-quarters of a turn at constant speed. The curve representing the transfer wheel is therefore a straight line (A G).

During two quarter-turns of the wheel 3, the receiver wheel 1 is halted and its representative curve is therefore composed of two horizontal straight-line segments (H C) and (F J) connected together by a curve (C F). The abscissae and the ordinates of the end points (C) and (F) are separated by 90° because the wheel 1 turns one quarter turn at a speed of 1 turn per cycle, i.e., during one quarter of a cycle. The position of the points (C) and (F) and also the shape of the curve (C F) are determined by the characteristics of the cam 54.

The intermediate wheel 2 must move during one part of the cycle at the speed of the receiver wheel 1 and during another part of the cycle at the speed of the transfer wheel 3, these two parts being connected together by periods during which the speed of the wheel 2 increases or decreases progressively to attain the desired value. Consequently, the following can be distinguished in the graph:

A part (A B) of the straight line (A G) during which the intermediate wheel 2 is at the speed of the transfer wheel 3;

A part (B D) during which the speed of the intermediate wheel 2 decreases progressively to attain the speed of the receiver wheel 1, and which is consequently represented by a curve tangent at B to the straight line (A G) and at D to the curve (H C F J);

A part (D E) during which the two plates 1 and 2 turn at the same speed and which is therefore composed of a segment of the curve representing the wheel 1. It is during this time that the projectile is transferred from the receiver wheel 1 to the intermediate wheel 2, and the distance on the abscissa between the points (D) and (E) must therefore be greater than the angle through which the intermediate wheel 2 turns between the moment when it starts to take over the projectile coming from the receiver wheel 1 and the moment when the projectile starts to be taken over by the transfer wheel 3. This angle may for example be 60°.

At the point (E) where, precisely, the projectile starts to be taken over by the transfer wheel 3, the speed of the intermediate wheel 2, and consequently that of the receiver wheel 1, must be equal to the speed of the transfer wheel 3. For this reason the shape of the cam 54 is so designed that the curve (C F) representing the variation of speed of the receiver wheel 1 will be tangent at (E) to the straight line (A G) representing the rotation of the transfer wheel 3.

After the point (E) the speed of the receiver wheel 1 decreases progressively until it becomes zero at (F). On the other hand, the speed of the intermediate wheel 2 is equal to that of the transfer wheel 3, and the curve representing the rotation of the wheel 2 is therefore represented by the segment (E G) extended by the segment (A B), i.e., as far as the point where the speed of the intermediate wheel starts to decrease again for a new cycle. It is during this time that the projectile is transferred from the intermediate wheel 2 to the transfer wheel 3.

In the drawings a mechanism has been shown by way of example which makes it possible to vary the speed of rotation of the intermediate wheel according to the desired law.

The drive pinion 22 fastened on the shaft 21 of the wheel 2 is connected by a pinion 23 to a pinion 24 of the same diameter, in such a manner that the pinions 22 and 24 turn in the same direction and at the same speed.

The pinion 24 is rotationally fixed to a planet gear 61 of a differential 6, in which the other planet gear 62 is rotationally fixed to the pinion 34 (FIG. 5) driven rotationally at the same speed as the pinion 32 driving wheels 3, and in the opposite direction. In this way, if the differential 6 makes no correction, the drive pinion 22 of the intermediate wheel 2 and the drive pinion 32 of the transfer wheel 3 are driven in the same direction and at the same speed by means of the planet gears of the differential 6.

The differential pinions 63 of the differential 6 are carried by a central shaft 64 which is provided with a crank 65 carrying at its end a roller 66. This roller rolls on a cam 7 provided on a disc fastened on the indexing drive shaft 51.

Figure 7:
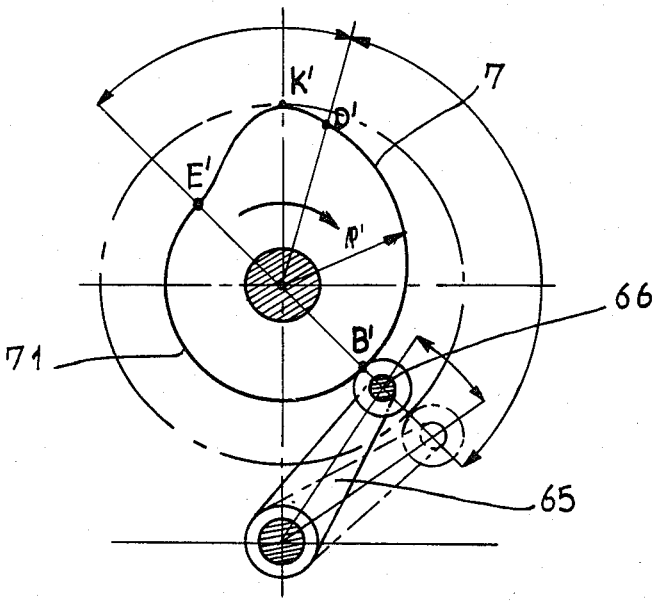
FIG. 7 is a detail view of a control cam.

FIG. 7 shows by way of example, on a larger scale, the profile which may be given to the cam 7 cooperating with the roller 66 and the crank 65 for the purpose of accelerating or slowing down the intermediate wheel 2 in relation to the transfer wheel 3.

In view of the fact that wheels 2 and 3 turn at the same speed during the time required for passing the projectile from one of them to the other, all the remainder of the cycle is available for varying the speed of the intermediate wheel 2. In FIG. 8, for example, it can be seen that it has been decided to rotate the intermediate wheel 2 at the speed of the transfer wheel during the half of the cycle which corresponds to the segments (E G) and (A B). During all this time no correction must be made to the speed of the planet wheel 61 relative to the speed of the planet wheel 62, and consequently the corresponding part 71 of the cam 7, lying between the points E′ and B′ (FIG. 7) is a half-circle.

In FIG. 8 it is possible to measure at each instant (t) in the cycle the angular offset (p) which must exist between wheels 2 and 3 to correspond to the difference in the ordinates of the points (P1) of the straight line (A G) representing the movement of wheel 3 and (P2) of the curve (A B D E G) representing the movement of wheel 2, which correspond to the instant (t) in the cycle. The angle (10) thus corresponds to the correction which must be made at each instant by the cam 7 to the movements of wheel 2. This correction is maximum at the point (K) where the tangent to the curve (A B D E G) is parallel to the straight line (A G). The plate 2 turns at a lower speed than wheel 3 between the points (B) and (K), and at a higher speed between the points (K) and (E). If we take as ordinate at each point the angular correction (p) which has to be made, it is possible to deduce therefrom the curve (L) representing the correction which has to be made by the cam. As has been indicated, this correction is distributed between the points (B′) and (E′) of the cam, and the point (K1) of the curve (L) corresponds angularly to the apex K′ of the cam at which correction is maximum. The ratio between the ordinates (p1) of the curve (1) and the distance (p′) of the points of the cam to the center of rotation are calculated with due regard to the speed ratios given by the differential.

To sum up, the movements of the intermediate wheel 2 relative to wheel 3 are as follows:

The two wheels turn in synchronism on the segments (E G) and (A B). Starting from the point (B), the speed of wheel 2 decreases until it becomes equal to that of wheel 1 at the point (D). This speed is moreover almost zero, because at that point the receiver wheel has only just started to rotate. The speed of the two wheels 1 and 2 rapidly increases until at the point (K) it becomes equal to that of the wheel 3. It continues to increase so that wheel 2 turns through the angle required to overtake the angular position of wheel 3, and then decreases again, so that at the point (E) the three wheels are at the same speed. Between the points (D) and (E) the projectile has been transferred from wheel 1 to wheel 2. Starting from the point e, the projectile can be transferred from wheel 2 to wheel 3, whose shafts are turning at the same speed.

The means have thus been defined which make it possible to introduce in a continuous displacement cycle the projectiles arriving discontinuously at the outlet of the feed corridor.

The variations of speed of the wheels, which in the example given are controlled by mechanical means, could also be achieved with hydraulic or electronic means.

Finally, although the invention has been described in the case of the conveying of projectiles, it could also be applied to the conveying of other objects whenever it is required to introduce, into a continuous movement corridor, objects which arrive discontinuously at the inlet of that corridor.

I claim:

1. In an artillery turret installation, apparatus for transferring projectiles (M) from a feed corridor (10) along which said projectiles are moved axially in sequence, separated by safety intervals, into a transfer corridor (4) in which said projectiles are moved side by side perpendicularly to their axes, said transfer corridor being defined by parallel guide members, a series of transfer star wheels (3′) being mounted for rotation about axes at right angles to said guide members and rotationally driven in synchronism by a main drive means (33), each of said transfer star wheels (3′) having at least one socket of a section corresponding to that of a said projectile, said socket being associated with two arms respectively taking over a projectile coming from a preceding star wheel and propelling it toward a succeeding star wheel, the improvement comprising:

(a) a receiving wheel (1) for receiving said projectiles (M) at the outlet of said feed corridor (10), said guide members extending to said receiving wheel, said receiving wheel having at least one socket for centering on the axis of said feed corridor by rotation about an axis (11) at right angles to said guide members, the safety interval separating said projectiles corresponding to the time required for replacement of a said socket by a succeeding socket;

(b) means (5, 53) for controlling, at regular intervals corresponding to the rhythm of succession of said projectiles at the outlet of said feed corridor, the rotation of said receiving wheel (1) through an angle (A) corresponding to the replacement of the socket by the next socket in the axis of said feed corridor;

(c) at least one intermediate wheel (2) also associated with said guide members and provided with a number of sockets equal to the number of sockets in said transfer star wheels, said intermediate wheel being interposed between said receiving wheel (1) and a first said transfer star wheel (3) for passing said projectiles (M) from one wheel to the other by rotation about an axis (21) at right angles to said guide members;

(d) means for continuously rotationally driving said intermediate wheel (2) at variable speed; and (e) means (6, 7) for controlling periodic progressive variations of said speed of rotation between an angular velocity equal to that of said receiving wheel (1) and an angular velocity equal to that of said transfer star wheel (3) for each fraction of a revolution corresponding to the passing of an object from said receiving wheel to said transfer star wheel.

2. The improvement claimed in claim 1, wherein said means for the periodic control of the rotation of said receiving wheel (1) comprises an indexing member (5) driven in continuous rotation by said main drive means at an angular velocity of one revolution per cycle of replacement of a said projectile by the succeeding projectile, said indexing member being adapted to engage for a fraction of a revolution on a slope (54) associated with each socket (13) in said receiving wheel and forming a cam controlling the rotation of said wheel (1) at an angular velocity progressively increasing and then decreasing between two stop positions separated by the socket replacement angle (A).

3. The improvement claimed in claim 2, comprising a single intermediate wheel (2) effecting the connection between said receiving wheel (1) and the first said transfer wheel (3), and wherein said indexing member (5) produces an angular velocity of rotation of said receiver wheel (1) which progressively increases up to a speed equal to that of said transfer wheel (3) and then progressively decreases, and said means (6, 7) for controlling the periodic variations of the speed of said intermediate wheel (2) effect a deceleration of said wheel (2) down to a speed equal to that of said receiving wheel (1) and then an increase of speed in synchronism with said receiving wheel (1) up to the speed of said transfer wheels (3) during the rotation through the angle necessary for passing said projectile (M) from said intermediate wheel (2) to the first said transfer wheel (3), followed by a further slowing down at the beginning of the next cycle.

4. The improvement claimed in any one of claims 1 to 3, wherein said means for the rotational driving of said intermediate wheel is composed of a differential (6), of which one planet gear (62) is driven in synchronism with said transfer wheels (3'), while the other planet gear (61) controls the rotation of said intermediate wheel (2), and wherein said means controlling the variations of speed of said intermediate wheel (2) is an arm (65) controlling the orientation of the differential gear carrier shaft (64) of said differential (6), an end (66) of said arm cooperating with a cam (7) driven rotationally by said main drive means (33) at an angular velocity of one revolution per projectile replacement cycle, the profile of said cam bringing about, with the aid of said differential (6) and in dependence on the transmission ratios, the continuous variation, in each cycle, of the speed of said intermediate wheel (2) between the speed of said receiving wheel (1) and the speed of said transfer wheels (3').

5. The improvement claimed in claim 2, wherein each said slope associated with a socket in said receiving wheel (1) is a rectilinear slot (54) provided in a radial direction in a plate (53) fastened on the shaft (11) of said receiving wheel (1) and which can be engaged by a finger (50) situated at the end of an indexing arm (5) fastened on a shaft (51) driven rotationally by said main drive means (33) at a speed of one revolution per projectile replacement cycle.

* * * * *